US005957175A

United States Patent [19]

Smith

[11] Patent Number: 5,957,175

[45] Date of Patent: Sep. 28, 1999

[54] ADJUSTABLE LOG SPLITTING HEAD

[76] Inventor: John R. Smith, 750 E. Hill Rd., Ludlow, Vt. 05149

[21] Appl. No.: 08/982,292

[22] Filed: Jul. 10, 1998

Related U.S. Application Data

[63] Continuation-in-part of application No. 08/800,785, Feb. 14, 1997, Pat. No. 5,711,357.

[51] Int. Cl.[6] ..... B27L 7/00

[52] U.S. Cl. ..... 144/195.1; 144/195.8; 144/366

[58] Field of Search ..... 144/193.1, 195.1, 144/195.8, 366, 4.6; 254/104

[56] References Cited

U.S. PATENT DOCUMENTS

| | | | |
|---|---|---|---|
| 4,371,019 | 2/1983 | Jeffrey | 144/4.6 |
| 4,830,070 | 5/1989 | Nunnery | 144/195.8 |
| 5,711,357 | 1/1998 | Smith | 144/195.8 |

*Primary Examiner*—W. Donald Bray
*Attorney, Agent, or Firm*—Norman B. Rainer

[57] ABSTRACT

An adjustable multi-wedge splitting head for a log splitting apparatus includes a vertically oriented stationary post securing a slideably positionable first multiple splitting wedge assembly, and a vertically oriented stationary splitting wedge mounted forwardly of the stationary post and securing a slideably positionable second multiple splitting wedge assembly. By selectively positioning the first and second multiple splitting wedge assemblies, logs may be split into 2, 4, 6 or 8 pieces of firewood.

11 Claims, 2 Drawing Sheets

ADJUSTABLE LOG SPLITTING HEAD

RELATED APPLICATIONS

This application is a continuation-in-part of U.S. patent application Ser. No. 08/800,785, filed Feb. 14, 1997.

BACKGROUND OF THE INVENTION

1. Field of the Invention

This invention relates to apparatus for the splitting of wooden logs into small pieces useful as firewood.

2. Description of the Prior Art

Devices for converting logs into firewood generally employ a ram-type mechanism which forces logs of pre-cut length into a stationary wedge having sharpened edges. As the log is axially advanced into the wedge, the log splits into a plurality of sector-shaped pieces along cleavage lines that are generally directed radially with respect to the center axis and along medullar rays of the log. Typical examples of such devices are disclosed in U.S. Pat. Nos. 4,294,295; 4,353,401; 4,371,019; 4,371,020; and 5,287,902.

The diameter of the logs fed to the splitting wedge may vary between about 4" and 24". The larger diameter logs must be cut into a greater number of pieces than the smaller diameter logs. In the course of cutting a sequence of logs, it often happens that logs of widely different diameter are encountered, thereby requiring frequent adjustment of the apparatus so that the appropriate number of pieces are generated from each log. Such adjustment of the splitting conditions of the apparatus requires considerable operator time, thereby increasing the cost of the log-splitting operation.

U.S. Pat. No. 4,371,019 discloses a wedge which is adjustably positionable so as to center upon the log axis. However, none of the aforesaid patents disclose apparatus which permits quick and easy adjustment of the number of pieces to be generated from a given log. In particular, it is desirable that the apparatus be capable of splitting any size log into 2, 4, 6 or 8 pieces without requiring significant time or effort for re-adjustment between the different splitting modes.

Accordingly, a primary object of the present invention is to provide a wedge head for a log splitting apparatus whereby adjustment can be made so as to change the number of pieces that a given log will be split into.

It is another object of this invention to provide a wedge head as in the foregoing object wherein the adjustability of the splitting characteristic can be easily and quickly accomplished.

It is a further object of the present invention to provide a wedge head of the aforesaid nature which is of rugged and simple design amenable to low cost manufacture.

These objects and other objects and advantages of the invention will be apparent from the following description.

SUMMARY OF THE INVENTION

The above and other beneficial objects and advantages are accomplished in accordance with the present invention by an adjustable multi-wedge splitting head for a log splitting apparatus equipped with a ram and guide means for axially advancing pre-cut logs in a horizontal direction, said splitting head comprising:

a) a vertically oriented stationary post of substantially uniform cross-sectional configuration bounded by opposed front and rear flat surfaces, paired side surfaces, and upper and lower extremities, b) an elongated straight stationary splitting wedge disposed in vertical orientation forwardly of said front surface, c) a first multiple splitting wedge assembly slideably mounted upon and removable from said post, and first activating means which controllably slides said first multiple splitting wedge assembly upon said post, and d) a second multiple splitting wedge assembly slideably mounted upon and removable from said stationary splitting wedge, and second activating means which controllably slides said second multiple splitting wedge assembly upon said stationary splitting wedge.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
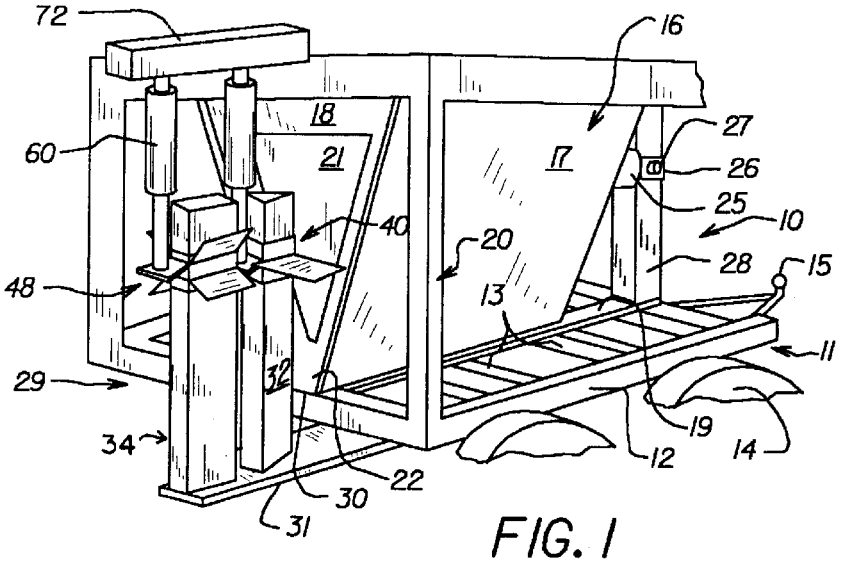
FIG. 1 is a rear and side perspective view showing an embodiment of the splitting head of the present invention in association with a conventional log splitting apparatus.

Referring to the drawings, a mobile log splitting apparatus, generally designated 10, embodying the present invention is shown comprised of a chassis or framework, generally designated 11, which includes spaced longitudinally extending side members 12, joined by spaced cross members 13, to form a unitary structure. The chassis 11 is mounted on four wheels 14 in a conventional manner and is provided with a conventional trailer tongue 15 whereby the log splitting apparatus 10 may be attached, for example, to a pickup truck, tractor or other prime mover and transported to a desired location.

A generally V-shaped open top guide chute 16 is mounted on chassis 11 and extends longitudinally thereof, said guide chute being comprised of a pair of inclined side walls 17 and 18 supported at the apex of the V by a longitudinally extended stringer 19 on chassis 11. The side walls 17 and 18 are also supported by a framework, generally designated 20 carried by the chassis 11.

A drive member 21, shown having a V-shaped contour is mounted for reciprocal movement in the generally V-shaped passageway 22 defined by side walls 17 and 18 of chute 16. In other equivalent embodiments, said drive member may have other contours while maintaining a substantially flat rear face 65. Said reciprocal movement of drive member 21 is achieved through the agency of a hydraulic ram 23 having a distal extremity 24 that engages the front face of drive member 21. The proximal extremity 25 of ram 23 is secured by way of clevis 26 and pin 27 to a vertically extending beam 28 which forms a part of framework 20.

In the illustrated embodiment, a multiple wedge splitting head 29 of the present invention is mounted on support beam 31 attached to framework 20 adjacent the exit rear end 30 of guide chute 16. Splitting head 29 includes an elongated straight stationary splitting wedge 32 of triangular shape disposed in vertical orientation and centered upon a plane of symmetry 33 that bisects the V-shape of guide chute 16. The forwardly directed cutting edge 66 of wedge 32 is disposed within said plane of symmetry.

A vertically oriented stationary post 34 of substantially uniform rectangular cross sectional configuration is positioned rearwardly of wedge 32 in alignment therewith in centered relationship upon plane 33. Post 34 is bounded by opposed flat front and rear surfaces 35 and 36, respectively, paired flat side surfaces 37, and upper and lower extremities 38 and 39, respectively. It is to be noted that, whereas lower extremity 39 abuts against support beam 31, to which it is attached, upper extremity 38 is free and unencumbered. In alternative embodiments, however, supporting arms attached to framework 20 may removably engage the upper extremity of post 34.

A first multiple splitting wedge assembly 48 includes a collar 49 slideably positionable upon post 34, and comprised of forward and back panels 54 and 55, respectively, and opposed side panels 56. An upper pair of wedge members 57 is emergent from side panels 56 in upwardly angled disposition. A lower pair of wedge members 58 is emergent from side panels 56 in downwardly angled disposition. The effect of said angled disposition is to displace said upper and lower pairs of wedge members about 45 degrees relative to a horizontal plane bisecting collar 49. All said wedge members have forwardly directed sharp edges 43. A control tab 59 is attached to back panel 55. First activating means in the form of hydraulic cylinder 60 having piston rod 61 is interactive between control tab 59 and upper securing means in the form of overhead beam 72 attached to framework 20.

A second multiple splitting wedge assembly 40 includes a collar 41 slideably positionable upon stationary splitting wedge 32. Collar 41 is comprised of back panel 52 and opposed side panels 53 which are forwardly convergent. Paired wedge members 42 are horizontally emergent from side panels 53 and have forwardly directed sharp edges 68 which are rearwardly displaced with respect to vertical cutting edge 66. Second activating means in the form of hydraulic cylinder 45 having piston rod 46, is interactive between control tab 44 rearwardly directed from back panel 52, and overhead beam 72.

In the operation of the splitting head of the present invention, a log 63 having a pre-cut length of between about 15 and 25 inches is dropped into chute 16 from overhead supply means. Drive member 21 is then urged against the log by ram 23, an action which forces the opposite extremity of the log into contact with cutting edge 66 of stationary vertical wedge 32, with consequent cleavage of the log into two halves.

When said first wedge assembly 48 is positioned above and out of contact with the log, and said second wedge assembly 40 is centered upon the axis of the log, the two horizontally disposed wedge members 42 split in two the two halves of the log, thereby producing four pieces of firewood from the initial log. Alternatively, when said second wedge assembly 40 is positioned above the log, and said first wedge assembly 48 is centered upon the axis of the log, the upper and lower pairs of wedge members 57 and 58, respectively, split into three sectors each half of the log, thereby producing six pieces of firewood from the initial log.

Figure 2:
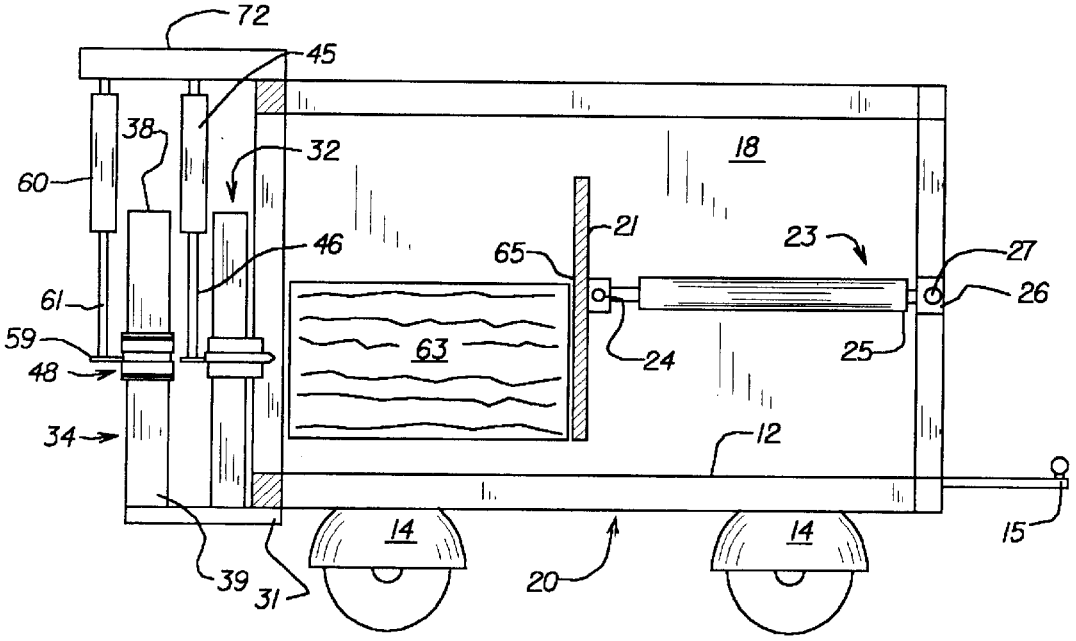
FIG. 2 is a side view of the splitting head and apparatus of FIG. 1 with portions broken away to reveal interior details.
Figure 3:
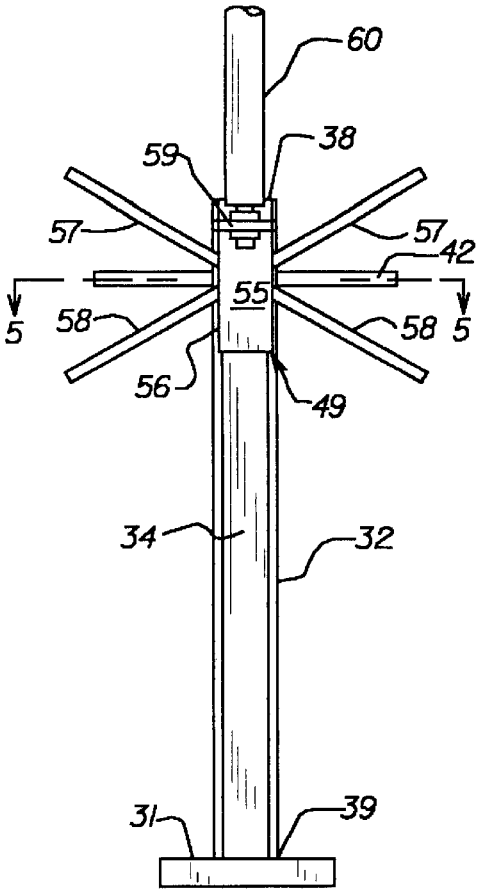
FIG. 3 is an enlarged rear view of the splitting head of FIG. 1.
Figure 4:
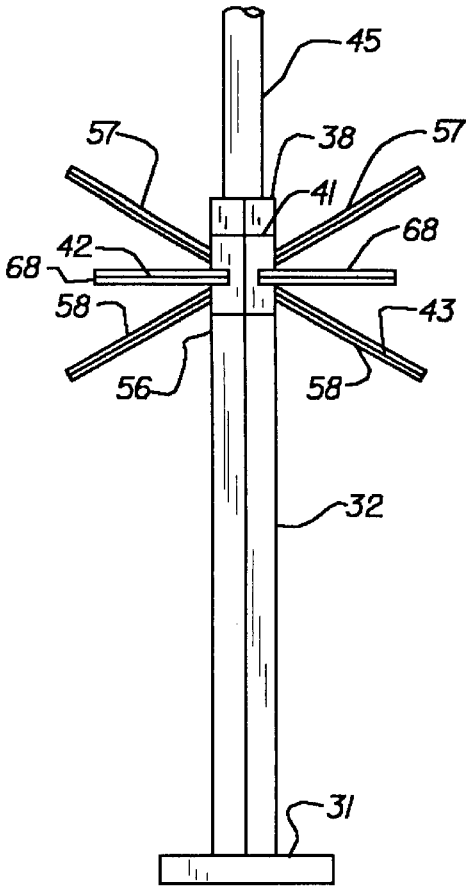
FIG. 4 is a front view of the splitting head.
Figure 5:
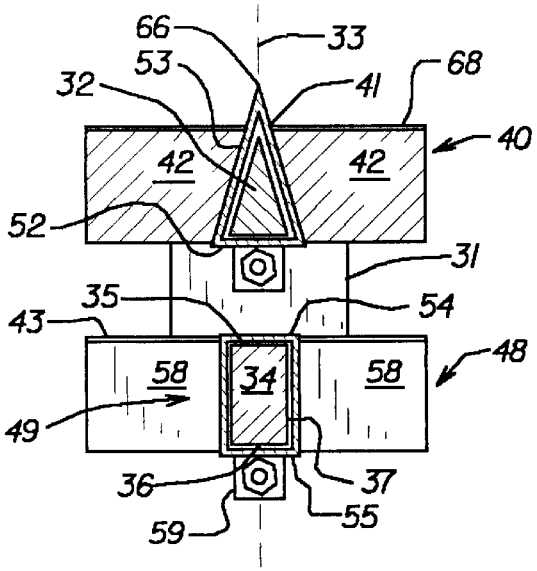
FIG. 5 is a sectional view taken in the direction of the arrows upon the line 5—5 of FIG. 3.

In a further mode of operation, both said first and second wedge assemblies 48 and 40, respectively, can be centered upon the log axis, as shown in the embodiment illustrated in FIGS. 1–5, thereby producing eight pieces of firewood from the initial log. For purposes of maintenance or repair, both wedge assemblies 48 and 40 can be removed upwardly from said adjustable multi-wedge head 29 by disconnecting said piston rods from their respective control tabs.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. An adjustable multi-wedge splitting head for a log splitting apparatus equipped with a ram and guide means for axially advancing pre-cut logs toward said splitting head in a horizontal direction, said splitting head comprising:

a) a vertically oriented stationary post of substantially uniform cross-sectional configuration bounded by opposed front and rear flat surfaces, paired side surfaces, and upper and lower extremities, b) an elongated straight stationary splitting wedge disposed in vertical orientation forwardly of said front surface, c) a first multiple splitting wedge assembly slideably mounted upon and removable from said post, and first activating means which controllably slides said first multiple splitting wedge assembly upon said post, and d) a second multiple splitting wedge assembly slideably mounted upon and removable from said stationary splitting wedge, and second activating means which controllably slides said second multiple splitting wedge assembly upon said stationary splitting wedge.

2. The splitting head of claim 1 wherein said stationary splitting wedge is of uniform triangular cross-sectional shape having a forwardly directed cutting edge.

3. The splitting head of claim 2 wherein said cutting edge lies within a plane of symmetry that vertically bisects said guide means.

4. The splitting head of claim 1 wherein said post has a rectangular cross-sectional configuration.

5. The splitting head of claim 4 wherein the upper extremity of said post is free and unencumbered.

6. The splitting head of claim 5 wherein said first multiple splitting wedge assembly includes a collar that is slideably positionable upon said post.

7. The splitting head of claim 6 wherein said collar is comprised of forward and back panels and opposed side panels.

8. The splitting head of claim 7 wherein an upper pair of wedge members is emergent from said side panels in an upwardly angled disposition, and a lower pair of wedge members is emergent from said side panels in a downwardly angled disposition, all said wedge members having forwardly directed sharp edges.

9. The splitting head of claim 1 wherein said first and second activating means are hydraulically operated piston rods.

10. The splitting head of claim 7 wherein a control tab is attached to said back panel, and is engaged by said first activating means.

11. The splitting head of claim 1 wherein said second multiple splitting wedge assembly is comprised of a collar slideably positionable upon said stationary splitting wedge, said collar having forwardly convergent side panels that secure paired horizontally directed wedge members having forwardly directed sharp edges.

* * * * *